US008544841B2

(12) United States Patent
Nakamura

(10) Patent No.: US 8,544,841 B2
(45) Date of Patent: Oct. 1, 2013

(54) SHEET DISCHARGE ROLLER WITH AXIALLY SPACED PLATE MEMBERS AND IMAGE FORMING APPARATUS HAVING THE SAME

(75) Inventor: Shigeo Nakamura, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 140 days.

(21) Appl. No.: 13/113,416

(22) Filed: May 23, 2011

(65) Prior Publication Data

US 2011/0309573 A1 Dec. 22, 2011

(30) Foreign Application Priority Data

Jun. 17, 2010 (JP) ..... 2010-138056

(51) Int. Cl.
*B65H 29/70* (2006.01)

(52) U.S. Cl.
CPC ..... *B65H 29/70* (2013.01)
USPC ..... 271/188

(58) Field of Classification Search
USPC ..... 271/188
See application file for complete search history.

(56) References Cited

U.S. PATENT DOCUMENTS 4,589,650 A * 5/1986 Miyoshi ..... 271/188
4,861,013 A * 8/1989 Shibata et al. ..... 271/119
5,188,350 A * 2/1993 Hayashi ..... 271/119
5,462,373 A * 10/1995 Chia ..... 271/114
5,558,322 A * 9/1996 Nakatomi ..... 271/209

FOREIGN PATENT DOCUMENTS

JP 01043446 A * 2/1989
JP 05-124762 A 5/1993
JP 9-301590 A 11/1997
JP 10-250893 A 9/1998
JP 11-049397 A 2/1999
JP 2002-362808 A 12/2002
JP 2003-040507 A 2/2003
JP 2006-206307 A 8/2006

OTHER PUBLICATIONS

Office Action (Decision to Grant Patent) dated Jul. 10, 2012, Issued in corresponding Japanese Patent Application No. 2010-138056, and an English Translation thereof. (6 pages).

* cited by examiner

*Primary Examiner* — Gerald McClain
(74) *Attorney, Agent, or Firm* — Buchanan Ingersoll & Rooney PC

(57) ABSTRACT

In a sheet discharge roller, a transportation roller includes a roller portion formed integrally on a rotation shaft, and an annular elastic member attached to a surface of the roller portion, each of rigidity increasing portions includes a plurality of plate members axially spaced from each other by a predetermined distance, and the plurality of plate members have forms each obtained by circumferentially dividing a circular plate, respectively, are arranged in positions circumferentially shifted from each other, respectively, and thereby exhibit an outer periphery of a substantially circular form when viewed in the axial direction.

11 Claims, 10 Drawing Sheets

RUBBER PORTION: NORMAL

RUBBER PORTION: EXPANDED

SHEET DISCHARGE ROLLER WITH AXIALLY SPACED PLATE MEMBERS AND IMAGE FORMING APPARATUS HAVING THE SAME

This application is based on Japanese Patent Application No. 2010-138056 filed with the Japan Patent Office on Jun. 17, 2010, the entire content of which is hereby incorporated by reference.

BACKGROUND OF THE INVENTION

1. Field of the Invention

The present invention relates to a sheet discharge roller employed in a sheet exit port of an image forming apparatus as well as an image forming apparatus provided with the sheet discharge roller.

2. Description of the Related Art

For improving sheet discharging performance for discharging paper sheets, processing of increasing rigidity of the paper sheet is performed by slightly curving the paper sheet in a direction (i.e., a widthwise direction of the paper sheet) perpendicular to a sheet discharging direction when the paper sheet is discharged from an exit port of an image forming apparatus. As a method for increasing rigidity of the paper sheet, there has been a method in which a rigidity increasing portion independent of a transportation roller (i.e., a roller for transportation) is arranged coaxially to the transportation roller.

The rigidity increasing portion has a larger outer diameter than the transportation roller, and is configured to deform the paper sheet with respect the widthwise direction of the paper sheet into a wavy form when viewed in a sheet discharging direction so that it increases the rigidity of the paper sheet in the sheet discharging direction and improves the paper sheet discharging performance.

Japanese Laid-Open Patent Publication Nos. 09-301590 and 2003-040507 are prior art references that have disclosed the above kind of sheet discharge rollers employing the rigidity increasing portions. In these references, the rigidity increasing portion employs a structure allowing removal from a rotation shaft.

In recent years, use of the rotation shaft molded of resin has been proposed and employed from a viewpoint of cost reduction of the image forming apparatus. In this case, a roller portion of a transportation roller and a rigidity increasing portion are formed integrally with the rotation shaft, and these are molded of resin.

A method of integrally forming the roller portion and the rigidity increasing portion on the rotation shaft is effective in cost reduction. However, it causes the following problems. For implementing the function as the roller for transportation, the roller portion molded of resin is provided at its surface with an annular rubber member attached thereto. A friction between the rubber member and the paper sheet provides a sheet transportation force. Although the rubber member is employed as an annular elastic member, this is not restrictive and, for example, an elastomer member or the like having similar characteristics may be used.

FIG. 21 shows a sheet discharge roller 9 in which roller portions and rigidity increasing portions are formed integrally with a rotation shaft. A rotation shaft 91 is provided with roller portions 93*a* axially spaced from each other by a predetermined distance. An annular rubber member 93*b* is attached to a surface of roller portion 93*a*. Roller portion 93*a* and rubber member 93*b* form a transportation roller 93.

Rotation shaft 91 is also provided with rigidity increasing portions 92 spaced from each other by a predetermined distance and each having a substantially cylindrical form. When viewed in the axial direction, an outer diameter of rigidity increasing portion 92 is larger than an outer diameter of transportation roller 93.

For combining rubber member 93*b* to roller portion 93*a* of sheet discharge roller 9 having the above structure, an elastic force of rubber member 93*b* is utilized, and rubber member 93*b* is radially expanded to have a diameter ϕD) equal to or larger than an outer diameter (ϕd) of rigidity increasing portion 92. However, rubber member 93*b* can be radially expanded only to a limited extent, and restricts the outer diameter of rigidity increasing portion 92 that is larger than the outer diameter of transportation roller 93. Conversely, the larger outer diameter of rigidity increasing portion 92 can increase the rigidity of the paper sheet.

As described above, it is preferable to reduce the outer diameter of rigidity increasing portion 92 from the viewpoint of the attaching rubber member 93*b* to roller portion 93*a* in the case where roller portion 93*a* and rigidity increasing portion 92 are integrally formed on rotation shaft 91. Conversely, it is preferable to increase the outer diameter of rigidity increasing portion 92 for increasing the rigidity of the paper sheets. Sheet discharge roller 9 must satisfy these conflicting requirements.

SUMMARY OF THE INVENTION

Accordingly, the invention has been made for overcoming the above problem, and an object of the invention is to provide a sheet discharge roller and an image forming apparatus having structures that sufficiently maintain a function of increasing rigidity of discharged sheets without lowering assembling efficiency.

According to the invention, a sheet discharge roller arranged in a sheet exit port of an image forming apparatus includes a rotation shaft; a plurality of transportation rollers arranged on the rotation shaft and axially spaced from each other by a predetermined distance; and a plurality of rigidity increasing portions formed integrally with the rotation shaft, and having an outer peripheral form larger than an outer diameter of the transportation roller when viewed in an axial direction for increasing rigidity of a paper sheet discharged from the sheet exit port by slightly curving the paper sheet with respect to a direction perpendicular to a discharging direction.

The transportation roller includes a roller portion formed integrally on the rotation shaft, and an annular elastic member attached to a surface of the roller portion. Each rigidity increasing portion includes a plurality of plate members axially spaced from each other by a predetermined distance.

The plurality of plate members have forms each obtained by circumferentially dividing a circular plate, respectively, are arranged in positions circumferentially shifted from each other, respectively, and thereby exhibit an outer periphery of a substantially circular form when viewed in the axial direction.

In another form of the invention, each of the plurality of plate members has a form obtained by substantially bisecting or trisecting a circular plate in the circumferential direction.

In another form of the invention, the plurality of plate members are arranged to have circumferential end portions overlapping together in the axial direction.

In another form of the invention, the plate member is provided at its outer periphery with a radially protruding convex portion.

In another form of the invention, the plate member has an outer peripheral length shorter than an inner peripheral length of the elastic member radially expanded to a maximum allowed extent.

In another form of the invention, the arrangement distance between the plate members is longer than an axial length of the elastic member axially compressed to a maximum extent.

An image forming apparatus based on the invention has one of the sheet discharge rollers described above in a sheet exit port The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6A shows a structure in which the rigidity increasing portion is formed of two plate members, and FIG. 6B shows a structure in which the rigidity increasing portion is formed of three plate members.

FIG. 12A shows a state where an external force is not applied, and FIG. 12B shows a state where the external force is applied in the radial direction.

DESCRIPTION OF THE PREFERRED EMBODIMENTS

A sheet discharge roller and an image forming apparatus according to each embodiment based on the invention will be described below with reference to the drawings. In the following description of the embodiments, numbers of items, quantities and others do not restrict the scope of the invention, unless otherwise specified. The same or corresponding parts bear the same reference numbers, and description thereof may not be repeated. Appropriate combinations of the structures in the embodiments have been originally intended.

As an example of the image forming apparatus, the following description will be made on an image forming apparatus 1000 employing a general full-color electrophotographic system. However, the invention is not restricted to the full-color electrophotographic system, and may be applied to an image forming apparatus employing an image forming unit of a single color (e.g., black) that can form only monochrome images.

First Embodiment

Image Forming Apparatus 1000

Figure 1:
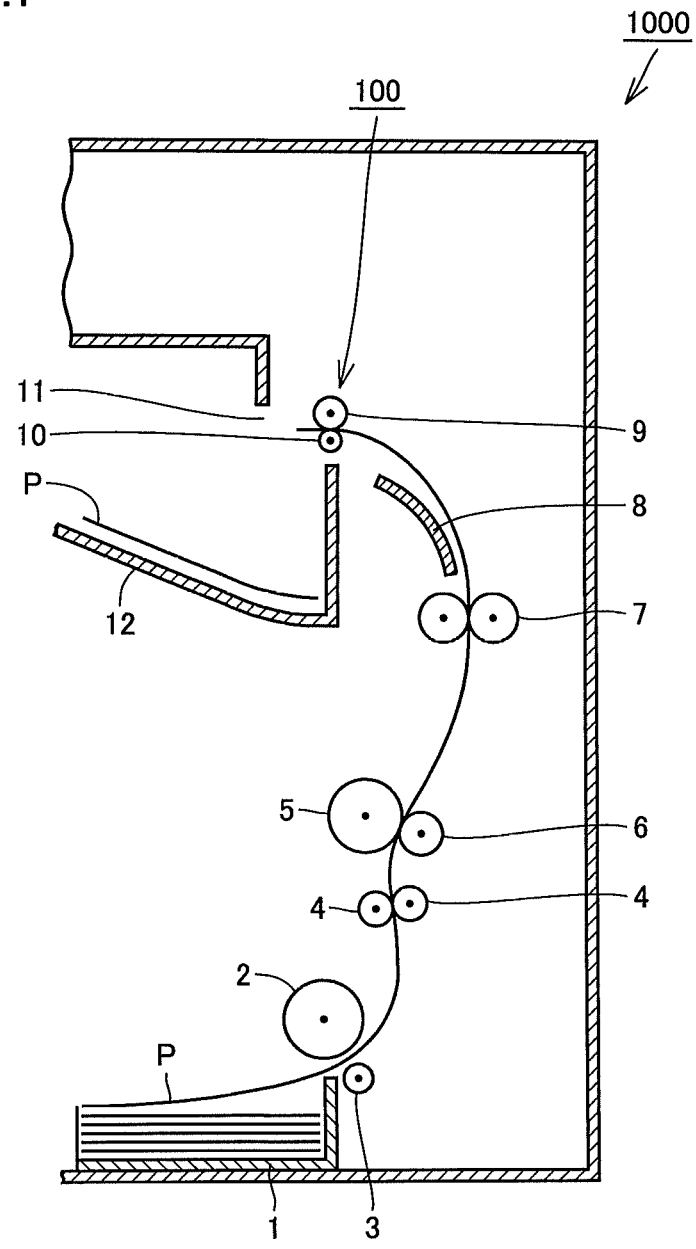
FIG. 1 is a longitudinal section showing a schematic structure of an image forming apparatus.

Referring to FIG. 1, image forming apparatus 1000 will be described below according to a flow of paper sheets P (transfer paper sheets).

When a feed roller 2 transfers paper sheet P transferred to a resist roller unit 4, a front edge of paper sheet P is pushed against resist roller unit 4 for appropriately aligning the forward edge while keeping a loop.

When preparation for writing is completed, resist roller unit 4 starts rotation to transfer a toner image electrostatically held on a photoreceptor 5 onto paper sheet P at a nip of transfer roller 6 in a synchronized fashion. Paper sheet P bearing the transferred toner image is transported to a fixing roller nip portion 7, where the toner image is fixed.

Paper sheet P bearing the fixed toner image is fed through a sheet discharge guide unit 8 into a sheet discharge roller unit 100. Sheet discharge roller unit 100 has a sheet discharge roller 9 and a pressure roller 10 opposed to sheet discharge roller 9. Paper sheet P held between sheet discharge roller 9 and pressure roller 10 is externally discharged from image forming apparatus 1000 through a sheet exit port 11. Paper sheet P externally discharged from image forming apparatus 1000 is stacked on a discharged sheet stacker 12.

Paper sheet P bearing the fixed toner image curls with respect to a sheet transportation direction due to influences of heat applied during the fixing and a curvature form of sheet discharge guide unit 8. Therefore, when paper sheet P is discharged from sheet exit port 11, the paper sheet thus discharged comes into contact with rear edges of the paper sheets already stacked on discharged sheet stacker 12 so that a failure occurs in accumulation of the paper sheets on discharged sheet stacker 12.

For overcoming the above problem, sheet discharge roller 9 is provided with a rigidity increasing portion for increasing rigidity of paper sheet P by slightly curving it with respect to a direction perpendicular to the sheet discharging direction. The increasing of the rigidity is performed by curving or waving paper sheet P. By increasing the rigidity of paper sheet P, it is possible to prevent curling of paper sheet P stacked on discharged sheet stacker 12 so that paper sheet P can keep a substantially horizontal state on discharged sheet stacker 12.

Structure of Sheet Discharge Roller Unit 100

Figure 2:
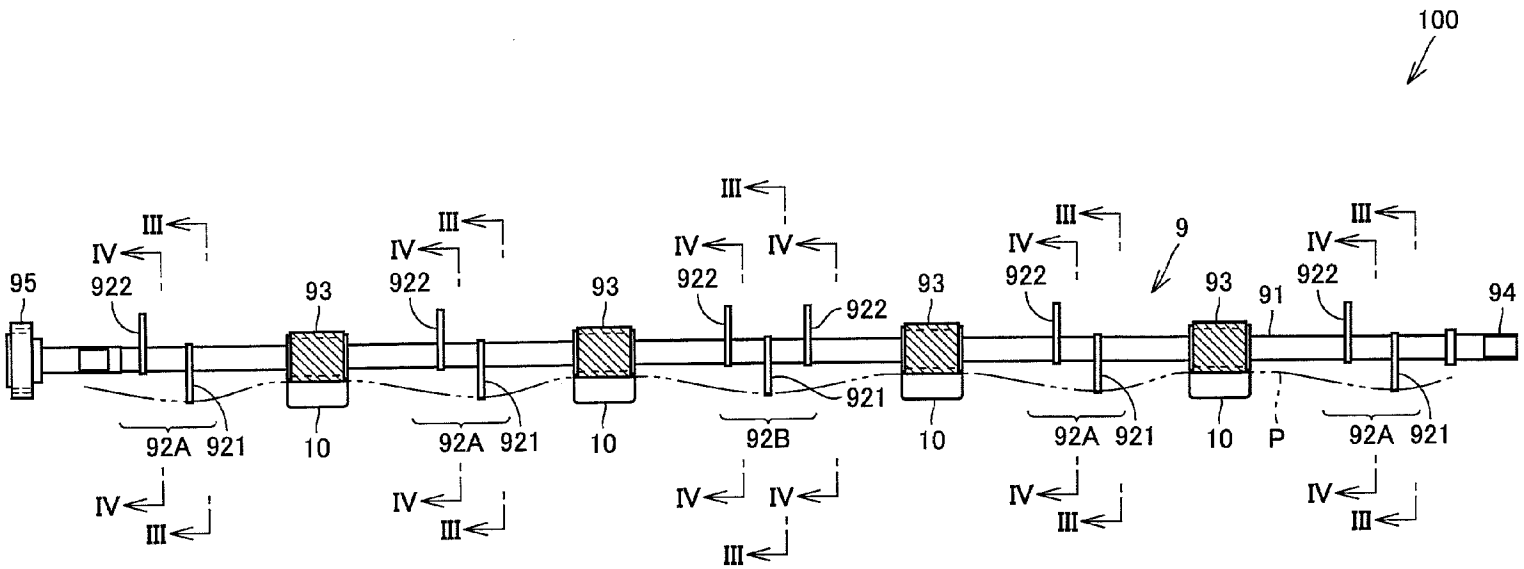
FIG. 2 is a whole plan view of a sheet discharge roller unit arranged at a sheet exit port of the image forming apparatus of a first embodiment.

Referring to FIG. 2, sheet discharge roller unit 100 will be described below. Sheet discharge roller unit 100 has sheet discharge roller 9 and pressure roller 10.

Sheet discharge roller 9 has a rotation shaft 91 made of resin, a plurality of transportation rollers 93 (i.e., rollers for transportation) arranged on rotation shaft 91 and axially spaced from each other by a predetermined distance, and rigidity increasing portions 92A and 92B that are molded of resin together with rotation shaft 91.

In an axial view, each of rigidity increasing portions 92A and 92B has an outer diameter larger than that of transportation roller 93. Rotation shaft 91 is integrally provided at its one end side with a bearing fitting portion 94 molded of resin, and is integrally provided at the other end side with a gear 95 molded of resin.

Transportation roller 93 is arranged in each of positions between neighboring rigidity increasing portions 92A and 92B. Also, transportation rollers 93 at the opposite ends are arranged between bearing fitting portion 94 and neighboring transportation roller 93 and between gear 95 and neighboring transportation roller 93, respectively. In this embodiment, transportation rollers 93 are arranged in four positions, respectively, and rigidity increasing portions 92A and 92B are arranged in five positions in total, respectively. The number and positions of the transportation rollers as well as the number and positions of the rigidity increasing portions are not restricted to those in the figures.

Structure of Rigidity Increasing Portions 92A And 92B

Each of rigidity increasing portions 92A and 92B includes a plurality of plate members axially spaced from each other by a predetermined distance. In this embodiment, each of four rigidity increasing portions 92A includes one plate member 921 and one plate member 922, and one rigidity increasing portion 92B arranged in the central position includes one plate member 921 and two plate members 922.

Referring to FIGS. 3 to 6A and 6B, forms of plate members 921 and 922 will be described below.

Figure 3:
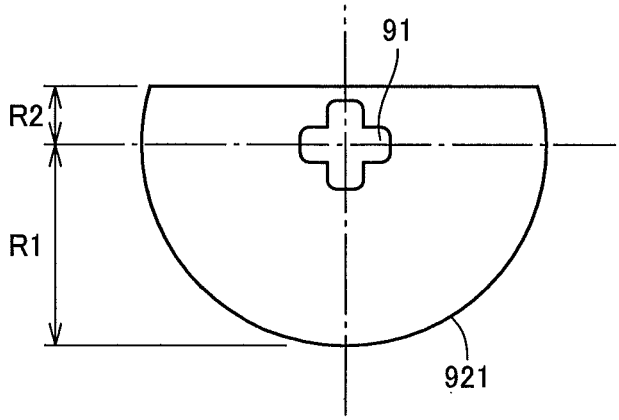
FIG. 3 is a view taken along line III-III in FIG. 2.

Referring to FIG. 3, plate member 921 has a form substantially obtained by circumferentially bisecting a circular plate. In the figure, it has a semicircular portion R1 located on a lower side with respect to rotation shaft 91, and also has a plate portion R2 located on an upper side with respect to rotation shaft 91.

Figure 4:
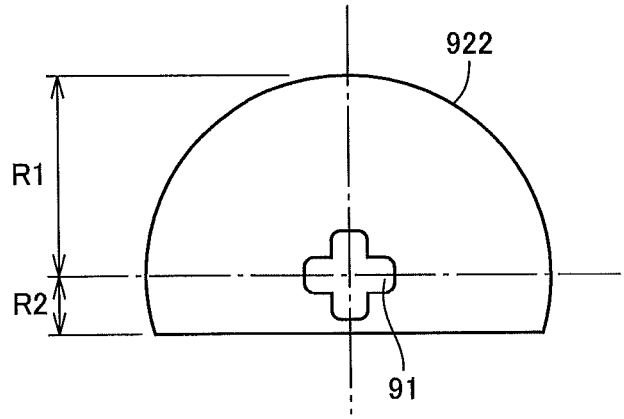
FIG. 4 is a view taken along line IV-IV in FIG. 2.

Referring to FIG. 4, plate member 922 has a form substantially obtained by circumferentially bisecting a circular plate. In the figure, it has semicircular portion R1 located on an upper side with respect to rotation shaft 91, and has plate portion R2 located on a lower side with respect to rotation shaft 91. Plate members 921 and 922 have the same form, and are circumferentially shifted from each other by 180 degrees around rotation shaft 91.

Figure 5:
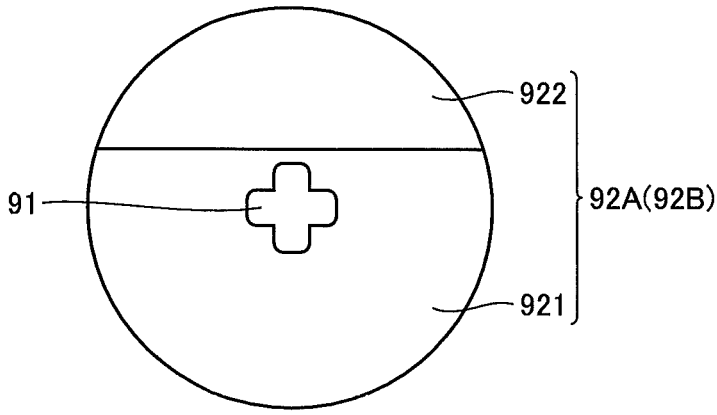
FIG. 5 is an axial view of a rigidity increasing portion in the first embodiment.

Thereby, as shown in FIG. 5, rigidity increasing portions 92A and 92B substantially exhibit a circular outer peripheral form when viewed in the axial direction. Plate members 921 and 922 are arranged so that circumferential end portions thereof mutually overlap when viewed in the axial direction.

Figure 6A:
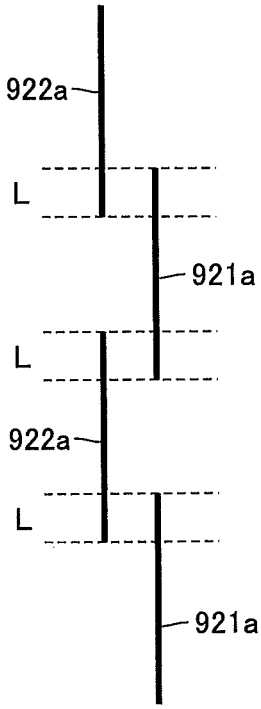
FIGS. 6A and 6B are schematic views showing loci of the rigidity increasing portion in the first embodiment. Particularly.
Figure 6B:
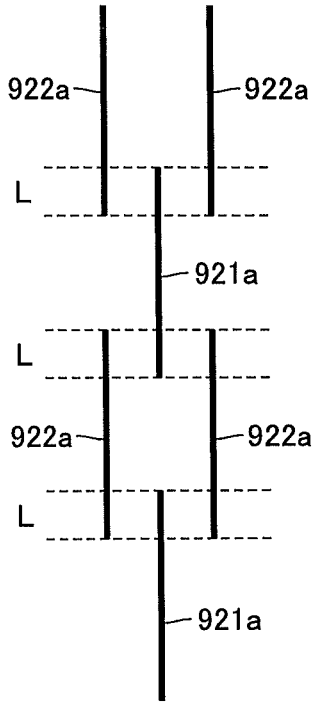

As a result, rigidity increasing portions 92A and 92B exhibit loci on paper sheet P as shown in FIGS. 6A and 6B. FIG. 6A shows the loci of rigidity increasing portion 92A on paper sheet P. Since there are regions where the circumferential ends of plate members 921 and 922 overlap together when viewed in the axial direction, there are regions L where loci 921*a* and 922*a* overlap together. Thereby, the rigidity can be increased in continuous portions of paper sheet P when the plate members are employed as the rigidity increasing portions.

FIG. 6B shows loci of rigidity increasing portion 92B on paper sheet P. Since there are regions where circumferential ends of one plate member 921 and two plate members 922 overlap together when viewed in the axial direction, there are regions L where loci 921*a* and 922*a* overlap together. Thereby, the rigidity can be increased in continuous portions of paper sheet P when the plate members are employed as the rigidity increasing portions, similarly to rigidity increasing portion 92A. Further, the plate members thereof are more by one than those of rigidity increasing portion 92A so that the rigidity increasing force can be increased.

Attaching of Rubber Member 93*b* To Roller Portion 93*a*

Referring to FIGS. 7 to 14A and 14B, attaching of rubber member 93*b* to roller portion 93*a* will be described below.

Figure 7:
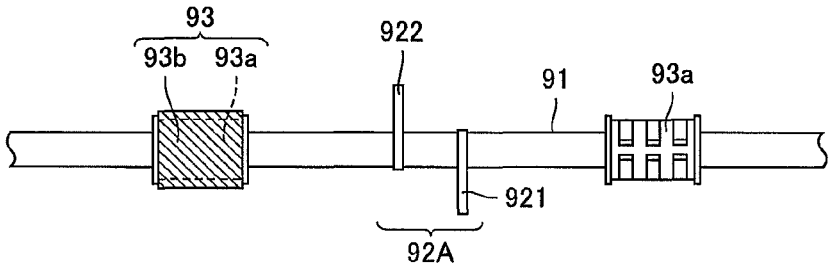
FIGS. 7 to 10 are first to fourth views showing states of attaching the rubber member to the roller portion in the first embodiment, respectively.

As shown in FIG. 7, transportation roller 93 includes roller portion 93*a* that is integrally molded of resin together with rotation shaft 91, and an annular elastic member attached to the surface of roller portion 93*a*. In this embodiment, the elastic member is annular rubber member 93*b*. FIG. 7 shows a state in which rubber member 93*b* is not attached to roller portion 93*a* on the right side.

Figure 8:
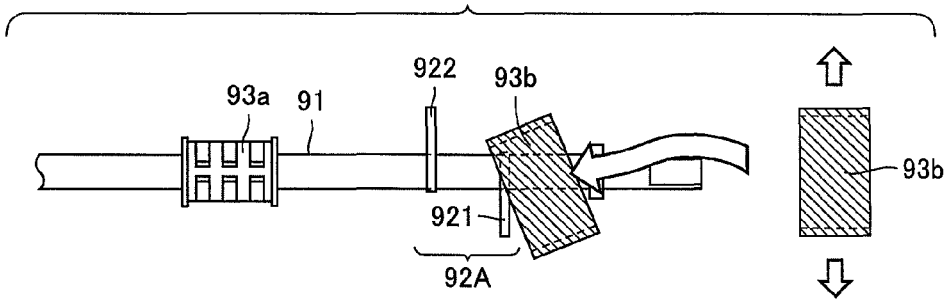
Figure 9:
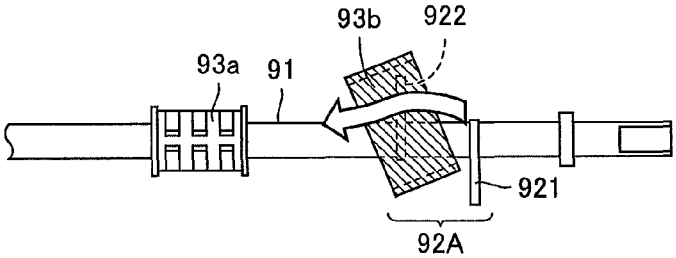
Figure 10:
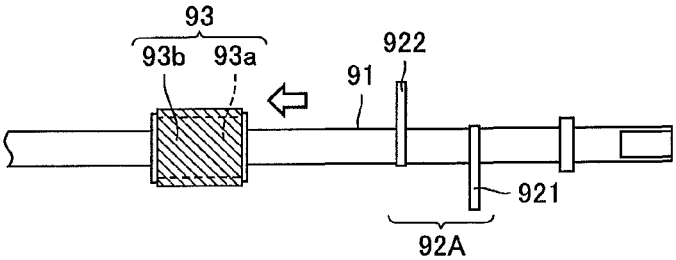

Referring to FIGS. 8 to 10, rubber member 93*b* is attached to roller portion 93*a* as follows. Rubber member 93*b* that is being radially expanded from one end side of rotation shaft 91 is fitted to rotation shaft 91, is passed over rigidity increasing portion 92A and is fitted around roller portion 93*a*.

In the above fitting operation, even when rigidity increasing portion 92A has an outer diameter equal to a conventional size, the outer diameters of plate members 921 and 922 are smaller than the outer diameter of rigidity increasing portions 92A as a whole, and this structure reduces an amount of radial expansion of rubber member 93*b* so that rubber member 93*b* can be easily attached to roller portion 93*a*.

When the allowed amount of radial expansion of rubber member 93*b* is equal to a conventional amount, the outer diameters of plate members 921 and 922 can be increased so that rigidity increasing portions 92A viewed as a whole can have a larger outer diameter than the conventional rigidity increasing portion, and therefore can increase the rigidity applied to paper sheet P to a higher extent.

Figure 11:
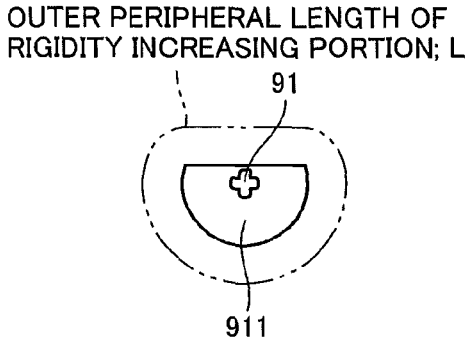
FIG. 11 shows a relationship between the rubber member and an outer peripheral length of the plate member in the first embodiment.
Figure 12A:
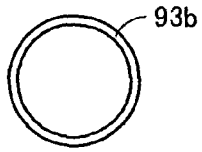
FIGS. 12A and 12B show an expanded state of the rubber member in the first embodiment. Particularly.
Figure 12B:
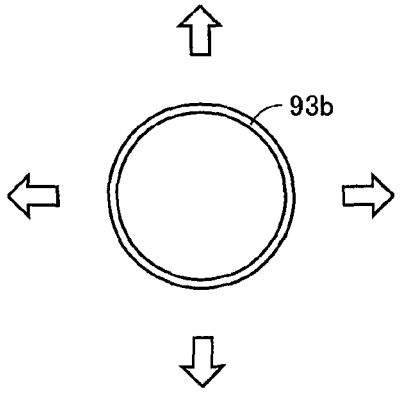

Relationship Between the Rubber Member And the Outer Peripheral Length of the Plate Member Referring to FIGS. 11, 12A and 12B, rubber member 93*b* is designed in connection with the amount of its radial expansion as follows. Rubber member 93*b* must be passed over plate members 921 and 922 by radially expanding it. Therefore, as shown in FIG. 11, when plate member 921 has an outer peripheral length of [L] and rubber member 93*b* radially expanded to the maximum allowed limit has the inner peripheral length of [D×π], rubber member 93*b* is designed such that [D×π] is larger than [L].

By designing rubber member 93*b* as follows, occurrence of permanent deformation of the rubber member can be prevented in the process of attaching rubber member 93*b* to roller portion 93*a*, and it is possible to prevent lowering of the transportation force of transportation roller 93 and occurrence of a problem in sheet discharging performance.

Figure 13:
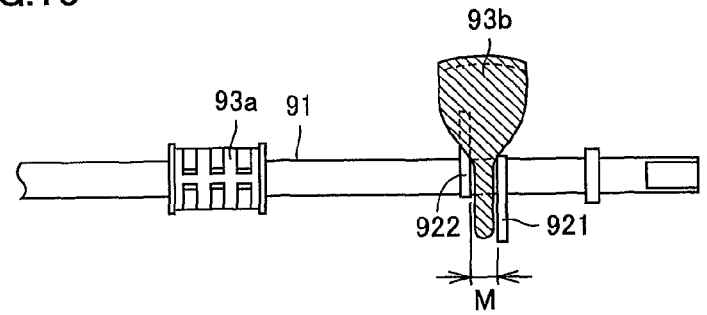
FIG. 13 shows a relationship between the rubber member and an arrangement space of the plate members in the first embodiment.
Figure 14:
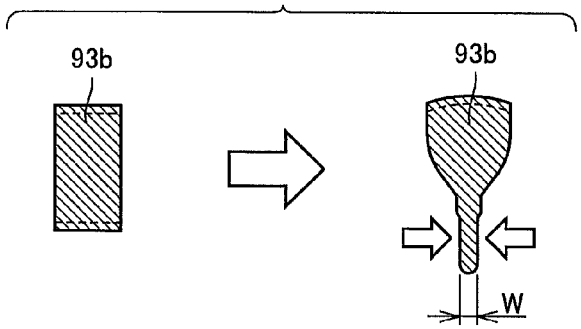
FIG. 14 shows a change of the rubber member to an expanded state in the first embodiment.
Figure 15:
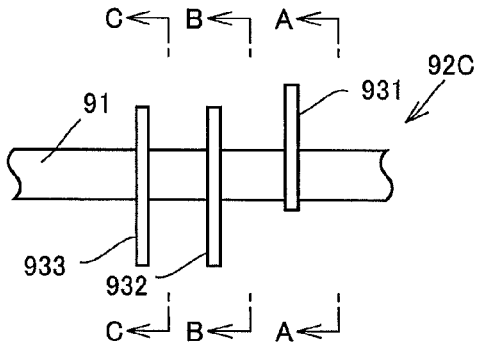
FIG. 15 is a plan showing a structure of a rigidity increasing portion in a second embodiment.

Relationship Between the Rubber Member And the Arrangement Distance Between the Plate Members Referring to FIGS. 13 and 14, the relationship between rubber member 93*b* and the arrangement distance between plate members 921 and 922 is determined as shown in FIG. 13, in which a minimum distance [M] between plate members 921 and 922 is larger than an axial length [W] of rubber member 93*b* axially compressed to a maximum extent. This design of the distance between plate members 921 and 922 can ensure the easiness in attaching rubber member 93*b* to roller portion 93*a*.

Operation And Effect

According to sheet discharge roller 9 in the embodiment, each of rigidity increasing portions 92A and 92B includes a plurality of plate members 921 and 922 axially spaced from each other by a predetermined distance, and each of plate members 921 and 922 has a form obtained by bisecting a circular plate in the circumferential direction, and is circumferentially shifted by 180 degrees from the other so that the outer peripheries of rigidity increasing portions 92A and 92B exhibit the substantially circular form larger than the outer peripheral form of transportation roller 93 when viewed in the axial direction.

This allows easy attaching of rubber member 93*b* to roller portion 93*a*. Further, sheet discharge roller 9 is employed as the sheet discharge roller arranged in sheet exit port 11 of image forming apparatus 1000 so that sufficient rigidity can be provided to paper sheet P.

Further, the number and positions of the transportation rollers, and the number and positions of the rigidity increasing portions as well as the form, number and positions of the plate members arranged for each rigidity increasing portion are not restricted to those of the embodiment described above. This is also true in connection with the following embodiments.

Second Embodiment

Referring to FIGS. 15 to 18, description will be made on the sheet discharge roller in a second embodiment. This embodiment differs from the first embodiment only in structure of a rigidity increasing portion 92C employed in the sheet discharge roller. Therefore, only the structure of rigidity increasing portion 92C in this embodiment will be specifically described below.

Rigidity increasing portion 92C has plate members 931, 932 and 933.

Figure 16A:
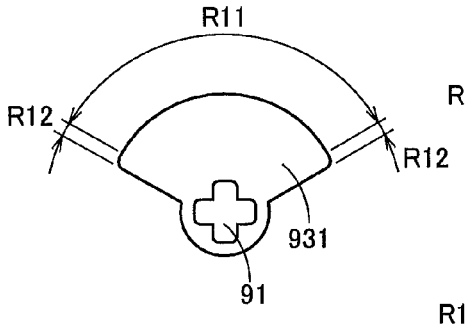
FIGS. 16A, 16B and 16C are views taken along lines A-A, B-B and C-C in FIG. 15, respectively.

Referring to FIG. 16A, plate member 931 has a form substantially corresponding to one of pieces obtained by circumferentially trisecting a circular plate. In the figure, it has a sectorial portion R11 on an upper side with respect to rotation shaft 91, and also has plate-like portions R12 that are located on the circumferentially opposite sides, respectively.

Figure 16B:
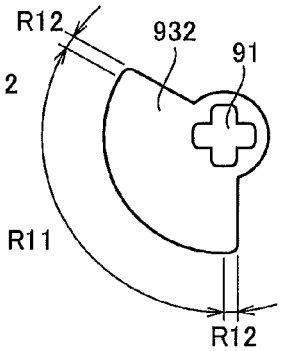

Referring to FIG. 16B, plate member 932 has a form substantially corresponding to one of pieces obtained by circumferentially trisecting a circular plate. In the figure, it has sectorial portion R11 on a lower left side with respect to rotation shaft 91, and also has plate-like portions R12 that are located on the circumferentially opposite sides, respectively.

Figure 16C:
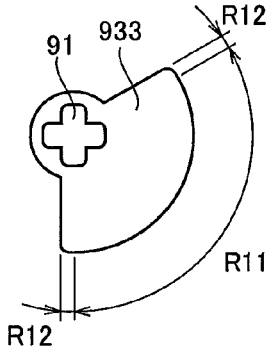

Referring to FIG. 16C, plate member 933 has a form substantially corresponding to one of pieces obtained by circumferentially trisecting a circular plate. In the figure, it has sectorial portion R11 on a lower right side with respect to rotation shaft 91, and also has plate-like portions R12 that are located on the circumferentially opposite sides, respectively.

Plate members 931, 932 and 933 have the same form, and are circumferentially shifted by 120 degrees from each other around rotation shaft 91.

Figure 17:
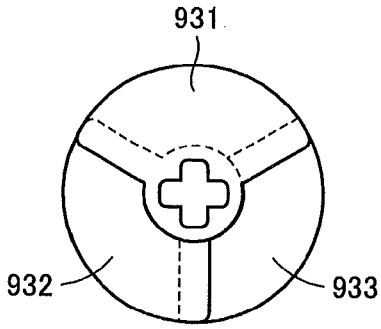
FIG. 17 is an axial view of the rigidity increasing portion in the second embodiment.

Thereby, as shown in FIG. 17, rigidity increasing portion 92C has an outer periphery of a substantially circular form when it is viewed axially. Plate members 931, 932 and 933 have circumferential end portions that overlap together in the axial direction when viewed in the axial direction.

Figure 18:
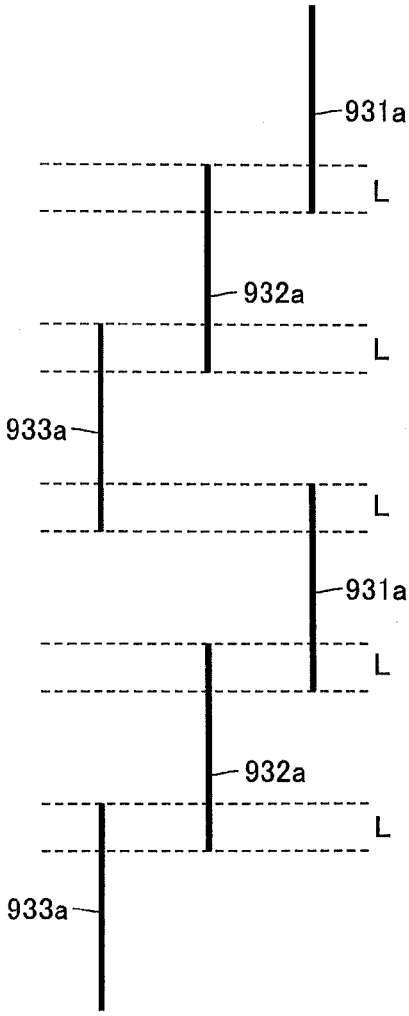
FIG. 18 is a schematic view showing loci of the rigidity increasing portion in the second embodiment.

Consequently, rigidity increasing portion 92C exhibits the loci shown in FIG. 18 on paper sheet P. Since plate members 931, 932 and 933 have the circumferential end regions (plate portions R2) that overlap together in the axial direction, loci 931*a*, 932*a* and 933*a* likewise form overlapping regions L.

Thereby, the structure employing the plate members as the rigidity increasing portions can likewise increase the rigidly of paper sheet P in a continuous fashion. Other structures of rigidity increasing portion 92C are the same as rigidity increasing portions 92A and 92B in the first embodiment already described.

Operation And Effect

As described above, the sheet discharge roller employing rigidity increasing portion 92C in the embodiment can likewise achieve substantially the same operation and effect as the first embodiment, and can implement easy attachment of the rubber member to the roller portion and provision of the sufficient rigidity in paper sheet P.

Third Embodiment

Figure 19:
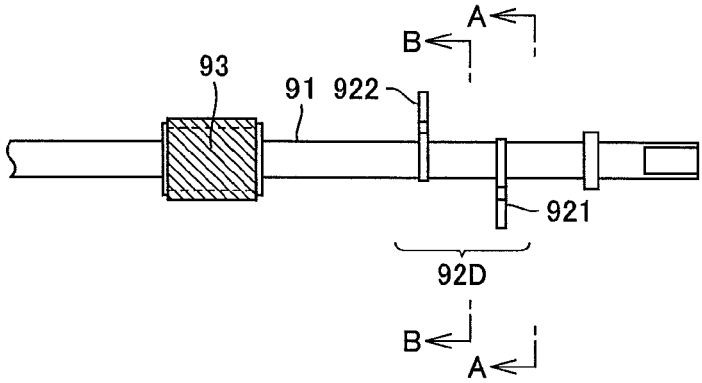
FIG. 19 is a plan showing a structure of a rigidity increasing portion in a third embodiment.
Figure 20A:
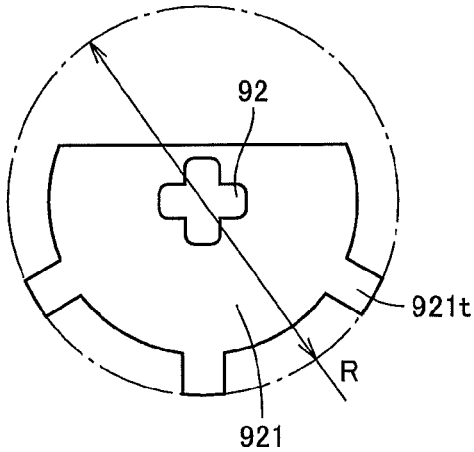
FIGS. 20A and 20B are views taken along lines A-A and B-B in FIG. 19, respectively.
Figure 20B:
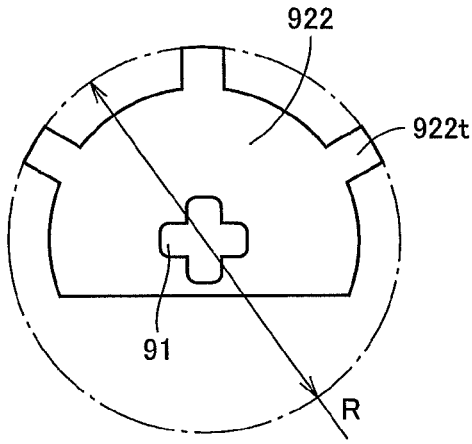
Figure 21:
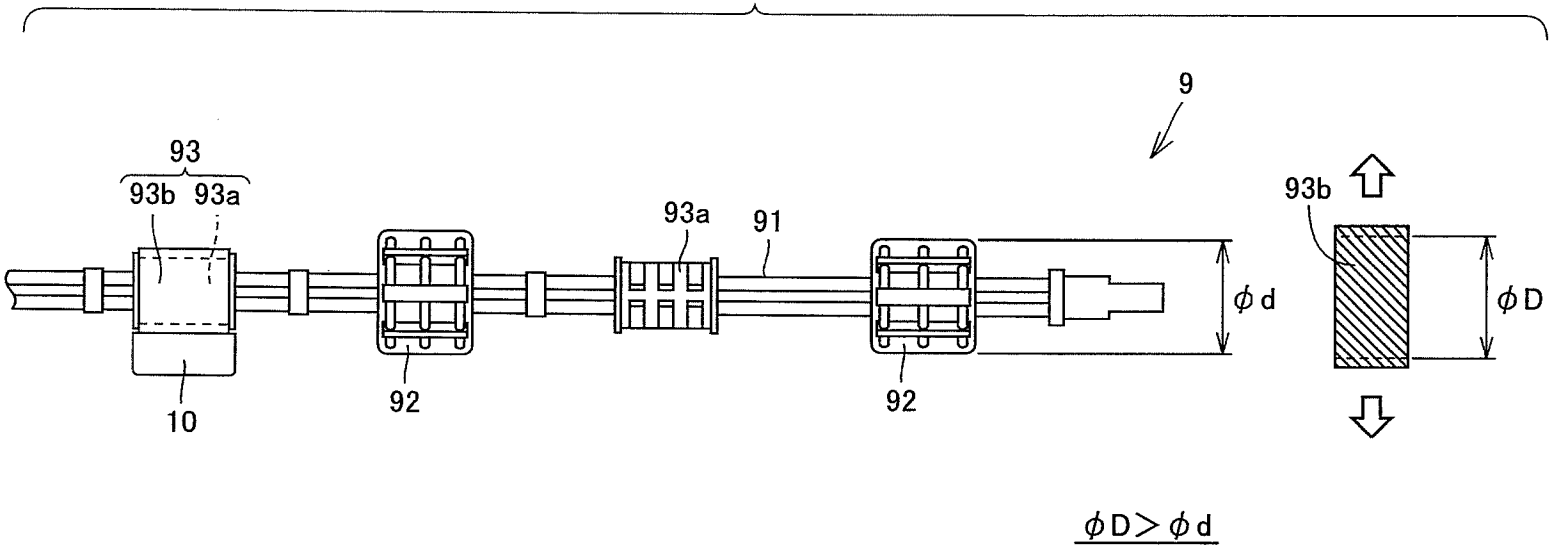
FIG. 21 is a fragmentary plan of a sheet discharge roller in a related art.

Referring to FIGS. 19, 20A and 20B, a sheet discharge roller of a third embodiment will be described below. This embodiment differs from the first embodiment already described only in the structure of a rigidity increasing portion 92D employed in the sheet discharge roller. Therefore, the structure of rigidity increasing portion 92D in this embodiment will be specifically described below.

Rigidity increasing portion 92D has the same basic structure as rigidity increasing portion 92A already described in connection with the first embodiment, and has plate members 921 and 922 having substantially the same form. There is a difference that each of plate members 921 and 922 is provided at its outer periphery with radially protruding convex portions 921*t*.

In this embodiment, each of plate members 921 and 922 is provided at its outer periphery with three convex portions 921*t*, but the number of convex portions 921*t* is not restricted to three. Other structures of rigidity increasing portion 92D are the same as those of rigidity increasing portion 92A in the first embodiment already described.

Operation And Effect

As described above, the sheet discharge roller employing rigidity increasing portion 92D in the embodiment can likewise achieve substantially the same operation and effect as the first embodiment, and can implement easy attachment of the rubber member to the roller portion and provision of the sufficient rigidity in paper sheet P.

Since each of plate members 921 and 922 is provided at its outer periphery with convex portions 921*t*, the irregular portions formed at the outer peripheral surfaces of plate members 921 and 922 kick out the rear end portion of paper sheet P when paper sheet P is being discharged. Consequently, the performance of discharging paper sheets P can be improved.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A sheet discharge roller arranged in a sheet exit port of an image forming apparatus, and comprising:

a rotation shaft;

a plurality of transportation rollers arranged on said rotation shaft and axially spaced from each other by a predetermined distance; and a plurality of rigidity increasing portions formed integrally with said rotation shaft, and having an outer peripheral form larger than an outer diameter of each of said transportation rollers when viewed in an axial direction, for increasing rigidity of a paper sheet discharged from said sheet exit port by curving the paper sheet with respect to a direction perpendicular to a discharging direction, wherein each transportation roller includes a roller portion formed integrally on said rotation shaft, and an annular elastic member attached to a circumferential surface of said roller portion, each of said rigidity increasing portions includes a plurality of plate members axially spaced from each other by a predetermined distance, and said plurality of plate members have forms each obtained by circumferentially dividing a circular plate, respectively, and are arranged in positions circumferentially shifted from each other, respectively, so that the plurality of plate members exhibit an outer periphery of a substantially circular form when viewed in the axial direction.

2. The sheet discharge roller according to claim 1, wherein each of said plurality of plate members has a form obtained by substantially bisecting or trisecting a circular plate in the circumferential direction.

3. The sheet discharge roller according to claim 1, wherein said plurality of plate members are arranged to have circumferential end portions overlapping together in the axial direction.

4. The sheet discharge roller according to claim 1, wherein each plate member is provided at its outer periphery with a radially protruding convex portion.

5. The sheet discharge roller according to claim 1, wherein each plate member has an outer peripheral length shorter than an inner peripheral length of said elastic member radially expanded to a maximum extent.

6. The sheet discharge roller according to claim 1, wherein the arrangement distance between said plate members is longer than an axial length of said elastic member axially compressed to a maximum extent.

7. The sheet discharge roller according to claim 1, wherein at least two plate members form an outer periphery of a substantially circular form when viewed in the axial direction.

8. The sheet discharge roller according to claim 1, wherein the roller portion is formed of the same material as the rotation shaft.

9. The sheet discharge roller according to claim 1, wherein the roller portion is formed of a different material than the annular elastic member.

10. The sheet discharge roller according to claim 1, wherein each plate member of the rigidity increasing portions is at least semi-circularly shaped.

11. An image forming apparatus having a sheet discharge roller in a sheet exit port, wherein said sheet discharge roller includes:

a rotation shaft, a plurality of transportation rollers arranged on said rotation shaft and axially spaced from each other by a predetermined distance, and a plurality of rigidity increasing portions formed integrally with said rotation shaft, and having an outer peripheral form larger than an outer diameter of each of said transportation rollers when viewed in an axial direction, for increasing rigidity of a paper sheet discharged from said sheet exit port by curving the paper sheet with respect to a direction perpendicular to a discharging direction;

each transportation roller includes a roller portion formed integrally on said rotation shaft, and an annular elastic member attached to a circumferential surface of said roller portion;

each of said rigidity increasing portions includes a plurality of plate members axially spaced from each other by a predetermined distance; and said plurality of plate members have forms each obtained by circumferentially dividing a circular plate, respectively, and are arranged in positions circumferentially shifted from each other, respectively, so that the plurality of plate members exhibit an outer periphery of a substantially circular form when viewed in the axial direction.

* * * * *